United States Patent [19]

Kalaf et al.

[11] 4,230,059

[45] Oct. 28, 1980

[54] NOISE ABATING SLEEVE

[75] Inventors: George P. Kalaf, Ashton; Irvin C. Henschen, Silver Spring, both of Md.

[73] Assignee: The United States of America as represented by the Secretary of the Navy, Washington, D.C.

[21] Appl. No.: 15,076

[22] Filed: Feb. 26, 1979

[51] Int. Cl.[3] ..... F42B 19/00

[52] U.S. Cl. ..... 114/20 R; 114/22

[58] Field of Search ..... 114/22, 20 R, 21 A; 102/7

[56] References Cited

U.S. PATENT DOCUMENTS

| | | | |
|---|---|---|---|
| 1,151,763 | 8/1915 | Dieter | 114/22 UX |
| 2,877,732 | 3/1959 | Eaton | 114/22 |
| 2,977,919 | 4/1961 | Blake | 114/20 R |
| 3,074,111 | 1/1963 | Wiltshire | 114/20 R X |
| 3,279,405 | 10/1966 | Billmeyer | 114/20 R |
| 3,372,662 | 3/1968 | Nisewanger | 114/20 R |

*Primary Examiner*—David H. Brown

*Attorney, Agent, or Firm*—R. S. Sciascia; A. L. Branning; D. A. Lashmit

[57] ABSTRACT

In an acoustic homing torpedo having a transducer section mounted forward of the nose shell, an elastomeric, acoustically transparent sleeve is installed over the torpedo nose section and extends aft of the discontinuity at the transducer/nose section interface, thereby reducing the torpedo self-noise generated by cavitation occurring at the discontinuity.

8 Claims, 3 Drawing Figures

NOISE ABATING SLEEVE

BACKGROUND OF THE INVENTION

The present invention relates generally to acoustic homing torpedoes and more specifically to the reduction of torpedo self-noise therefrom.

Acoustic homing torpedoes are generally constructed with an acoustic transducer section at the forward end of the torpedo nose shell. The transducer section contains transducer elements mounted behind an acoustically transparent dome which forms the nose end of the torpedo. The sensitive transducer elements presently in use are responsive not only to target noise, but also to the self-noise generated by the torpedo as it moves through the water. One source of the self-noise is the turbulence caused by the discontinuity at the joint where the transducer dome is affixed to the torpedo nose shell, resulting from the difficulty in machining the parts to achieve a perfectly smooth transition. This is particularly a problem when the torpedo is operating at shallow depths, since any discontinuities on the torpedo shell contribute to cavitation.

One method used in the prior art to overcome this problem was to machine the transducer to nose shell joint to a smooth contour, after the torpedo had been assembled. While this provided acceptable hydrodynamic performance, the assembly had to be remachined after the torpedo was repaired or refurbished to again achieve a smooth contour. Another method involved redesigning of the nose section to include on the transducer dome a skirt that extended rearward of the normal dome-nose section interface. This had the effect of shifting the noise source to a position where it would have a reduced effect on the performance of the torpedo. This method involves considerable time and expense, however, in that it necessitates the scrapping of existing nose sections and the installation of new ones on all torpedoes for which improved performance is required.

Thus, there is a need for an effective torpedo self-noise reduction device that is less costly and easier to install than prior art devices.

SUMMARY OF THE INVENTION

Accordingly, the present invention provides a noise abating sleeve that can be installed in the field without the need for transducer dome redesign or the use of complex machinery.

An elastomeric, acoustically transparent sleeve is attached over the front of the torpedo and extends aft of the location where the transducer dome is affixed to the torpedo shell. The sleeve is held in place by stretching or by an adhesive, and provides a smooth transition over the transducer dome to nose shell joint. Self-noise is thereby reduced by minimizing the flow disruption that would otherwise occur at the joint without the sleeve.

OBJECTS OF THE INVENTION

It is therefore an object of the present invention to provide an effective self-noise reduction device for acoustic homing torpedoes that is inexpensive and easily installed.

Another object of the present invention is to provide a noise abating sleeve that may be retrofitted to existing torpedo nose sections.

Still another object of the present invention is to provide a noise abating sleeve that is readily removable to facilitate rework or repair of the nose section.

BRIEF DESCRIPTION OF THE DRAWINGS

Other objects and many of the attendant advantages of the present invention will be readily apparent as the invention becomes better understood by reference to the following detailed description with the appended claims, when considered in conjunction with the accompanying drawings, wherein:

DESCRIPTION OF THE PREFERRED EMBODIMENT

Figure 1:
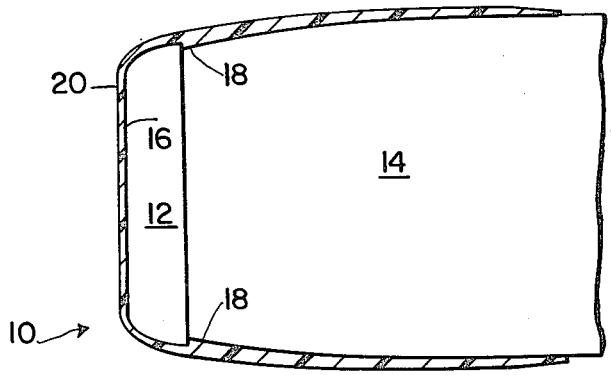
FIG. 1 is an elevational view of the nose section of a torpedo employing the noise abating sleeve, shown in cross-section, of the present invention.

Referring now to the drawings, wherein like reference numerals designate the same or corresponding parts throughout the several views, there is shown in FIG. 1 the nose section of an acoustic homing torpedo 10 having an acoustic transducer section 12 affixed to a nose shell 14. Transducer section 12 generally includes an array of acoustic transducers (not shown) mounted behind an acoustic dome 16 formed of a rigid, acoustically transparent material.

Figure 2:
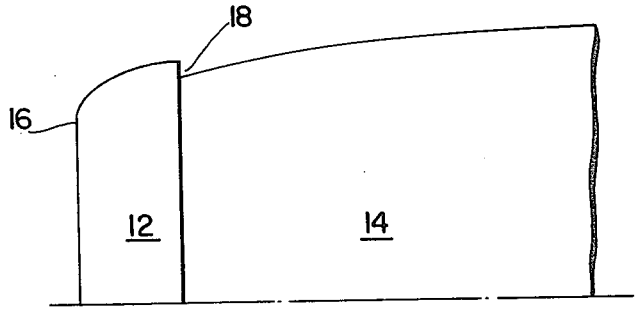
FIG. 2 is an enlarged elevational view of a portion of the torpedo shown in FIG. 1, wherein the transducer/-nose shell interface discontinuity is shown in greater detail.

When transducer section 12 is attached to nose shell 14 during the assembly of torpedo 10, there is invariably a discontinuity 18, shown in greater detail in FIG. 2, at the transducer/nose shell interface. A step-down discontinuity is illustrated in FIG. 2, although a step-up discontinuity may just as readily occur. Machining of the nose section after assembly of the torpedo reduces the discontunity 18 to some degree; however, this is an expensive and time consuming process requiring specialized equipment, and a finite step-up or step-down will still remain. Further, if the transducer section 12 is removed for repair or refurbishment, the torpedo 10 must be returned to a repair facility where the nose section can be re-machined.

As explained above, the discontinuity 18 that remains even after machining creates flow induced noise and leads to cavitation as the torpedo travels through the water at shallow depths. This self-noise often occurs in the frequency range of the transducer and can mask the target signals, thereby degrading the homing performance of the torpedo.

Figure 3:
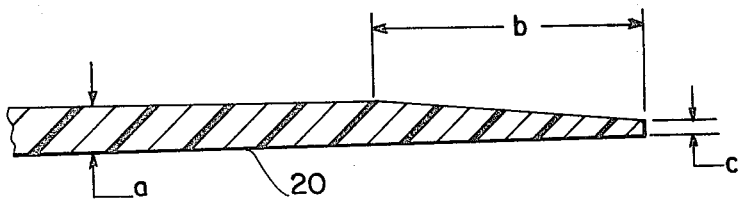
FIG. 3 is an enlarged cross-sectional view of the trailing edge of the noise abating sleeve of FIG. 1.

Referring again to FIG. 1, an elastomeric acoustically transparent sleeve 20 installed over the torpedo 10 nose section and extending well aft of the discontinuity 18 has been found to effectively reduce the self-noise evident in prior art homing torpedoes. Sleeve 20 smoothes the discontinuity 18 at the transducer section 12/nose section 14 interface. As shown in FIG. 3, the trailing edge of sleeve 20 is tapered and extends aft of the interface, which has the effect of moving the source of self-noise created by the sleeve 20/nose shell 14 interface to a location where the noise has a minimal effect on the acoustic performance of the transducers.

Sleeve 20 is formed of an acoustically transparent material, for example, polyurethane, and may advantageously be fabricated by such methods as injection molding, dipping, spraying, and the like. In one embodiment, sleeve 20 is sprayed into a mold in layers to a nominal thickness of approximately 0.020–0.040 inch. The sleeve is then finished to a surface smoothness of approximately 16 RMS and extends approximately 16 inches aft of the torpedo nose. The trailing edge of sleeve 20, as shown in FIG. 3, may advantageously be tapered down from the nominal thickness to a thickness of about 0.010 inch over a 2 inch width. Thus, in one embodiment of FIG. 3, "a"=0.020–0.040 inch; "b"=2 inches; and "c"=0.010 inch.

Sleeve 20 must be installed over torpedo 10 in such a manner that no voids or air bubbles are left between the sleeve and the torpedo. Any air pockets will create noise and thereby diminish the effectiveness of the sleeve. One method of installing sleeve 20 onto torpedo 10 is to build the sleeve approximately 5% undersize and stretch it over the nose section, with or without the use of an adhesive to bond the sleeve to the torpedo shell. If an adhesive is used, it must be impervious to water yet easily strippable so as to facilitate the removal of sleeve 20, should later repair of transducer section 12 become necessary. Another method of installation is to bond sleeve 20 to the torpedo 10 nose section in a relaxed condition.

The installation is followed by a buffing operation with emery cloth, or the like, to remove any surface irregularities that may have occured during fabrication, to achieve the desired final surface smoothness, and to taper the trailing edge of sleeve 20 as shown in FIG. 3.

A further advantage of the sleeve of the present invention is that it may readily be repaired in the field by using, for example, a urethane mixture as a caulking compound which can be cured in situ.

Thus, there has been provided by the present invention a field installable and repairable noise abating sleeve that minimizes torpedo self-noise and thereby enhances the operation of acoustic homing torpedoes.

Obviously, other embodiments and modifications of the present invention will readily come to those of ordinary skill in the art having the benefit of the teachings presented in the foregoing description and the drawings. It is, therefore, to be understood that this invention is not to be limited thereto and that said modifications and embodiments are intended to be included within the scope of the appended claims.

What is claimed and desired to be secured by Letters Patent of the United States is:

1. In a torpedo having a nose section formed of an acoustic transducer section affixed to the forward end of a torpedo nose shell, a method for reducing the flow induced self-noise generated by said torpedo as it travels through the water comprising the steps of:

fabricating an elastomeric, acoustically transparent sleeve conforming to the shape of said torpedo nose section, said sleeve having a trailing edge extending well aft of the interface between said transducer section and said nose shell;

installing said sleeve over said torpedo nose section in such a manner that all voids and air bubbles are removed from between said sleeve and the surface of said torpedo;

buffing the surface of said sleeve to obtain the desired level of smoothness; and tapering the trailing edge of said sleeve so as to minimize turbulance at the interface between said trailing edge and the surface of said torpedo.

2. The method of claim 1, further including the step of:

fabricating said sleeve up to approximately 5% undersize so that said sleeve is stretched during installation onto said torpedo nose section.

3. The method of claims 1 or 2, further including the step of:

applying an easily strippable adhesive between said sleeve and said torpedo nose section during installation of said sleeve, thereby firmly bonding said sleeve to said torpedo.

4. In a torpedo having a nose section formed of an acoustic transducer section affixed to the forward end of a torpedo nose shell, a noise abating device for reducing torpedo self-noise comprising:

an elongated sleeve having a closed forward end and an open aft end and conforming to the shape of said torpedo nose section, said sleeve being installed thereon;

said sleeve further being formed of an elastomeric, acoustically transparent materials having a smooth outer surface, said sleeve having a sufficient length so that said open end extends well aft of the interface between said transducer section and said nose shell when said sleeve is installed over said torpedo nose section;

said sleeve further having a tapered trailing edge about the circumference of said aft end.

5. The noise abating device of claim 4, wherein said elastomeric, acoustically transparent material is polyurethane.

6. The noise abating device of claim 4, wherein said sleeve is formed up to approximately 5% undersize, whereby said sleeve is stretched over said torpedo nose section during installation thereon.

7. The noise abating device of claim 4, wherein said sleeve has an easily strippable adhesive applied thereto prior to the installation of said sleeve over said torpedo nose section.

8. The noise abating device of claim 4, where said sleeve has a nominal thickness of less than approximately 0.040 inch.

* * * * *